US006569007B2

(12) United States Patent
Bastian et al.

(10) Patent No.: US 6,569,007 B2
(45) Date of Patent: May 27, 2003

(54) FUME HOOD WITH AIR CHAMBER AND PRESSURE PIPE

(75) Inventors: John M. Bastian, Manitowoc, WI (US); Thomas A. Grall, Whitelaw, WI (US); Anthony Castelli, Manitowoc, WI (US); Tony Kopidlansky, Manitowoc, WI (US)

(73) Assignee: Fisher Hamilton, Inc., Two Rivers, WI (US)

( * ) Notice: Subject to any disclaimer, the term of this patent is extended or adjusted under 35 U.S.C. 154(b) by 21 days.

(21) Appl. No.: 10/013,392

(22) Filed: Dec. 11, 2001

(65) Prior Publication Data

US 2003/0027513 A1 Feb. 6, 2003

Related U.S. Application Data

(63) Continuation-in-part of application No. 09/922,037, filed on Aug. 3, 2001, now Pat. No. 6,506,109.

(51) Int. Cl.[7] ..... B08B 15/02
(52) U.S. Cl. ..... 454/56; 312/209
(58) Field of Search ..... 454/57, 56, 58; 312/209, 229

(56) References Cited

U.S. PATENT DOCUMENTS 3,604,333 A * 9/1971 Nelson ..... 454/59
3,752,056 A * 8/1973 Chamberlin et al. ..... 454/59
3,811,250 A * 5/1974 Fowler, Jr. ..... 454/56
4,637,301 A * 1/1987 Shields ..... 454/57
4,723,480 A * 2/1988 Yagi et al. ..... 454/187

* cited by examiner

*Primary Examiner*—Derek S. Boles
(74) *Attorney, Agent, or Firm*—Rader, Fishman & Grauer PLLC

(57) ABSTRACT

A fume hood includes a top, bottom sidewalls, front panel and a back panel that define an enclosed workspace. The fume hood also includes a movable sash for opening and closing an access opening. The fume hood also includes an air chamber having an inlet in the front panel. The air chamber includes a baffle system that evenly distributes the inlet air as the air travels through the air chamber. An unimpeded flow of air is discharged downward and away from the breathing zone of the technician and proximate to the sash to reduce the forward momentum of air trying to escape the fume hood. In an alternate embodiment, the fume hood also includes a pressure pipe for drawing a small quantity of air from the air chamber and directing a flow of air between the movable sash and the header panel. This flow of air from the pressure pipe increases the relative pressure difference between the movable sash and the header panel of the fume hood. This design reduces the amount of condition air that is exhausted from the room through the fume hood, thereby lowering the operating cost and increasing the efficiency of the fume hood.

9 Claims, 5 Drawing Sheets

Fig. 2
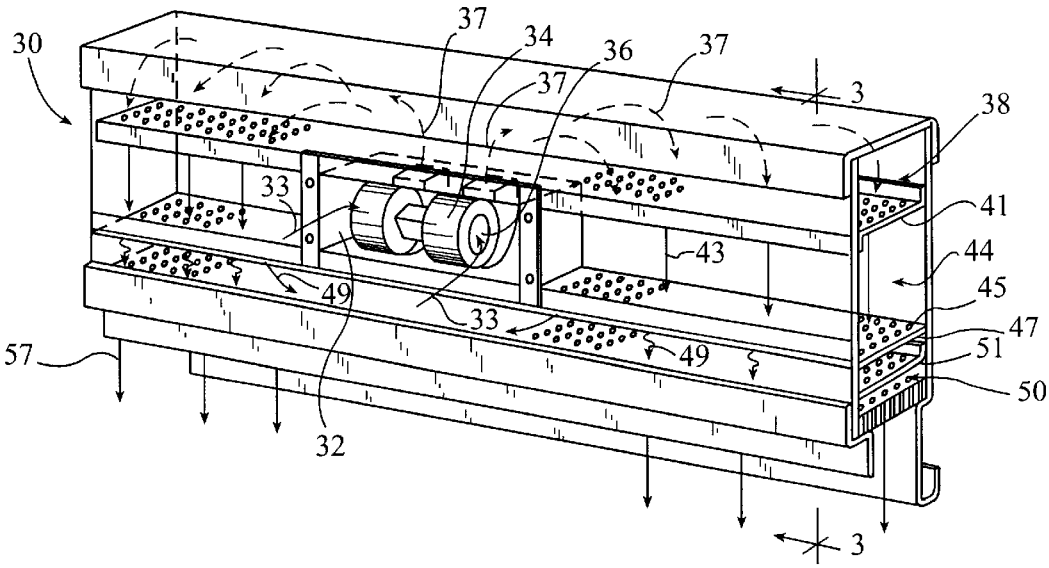
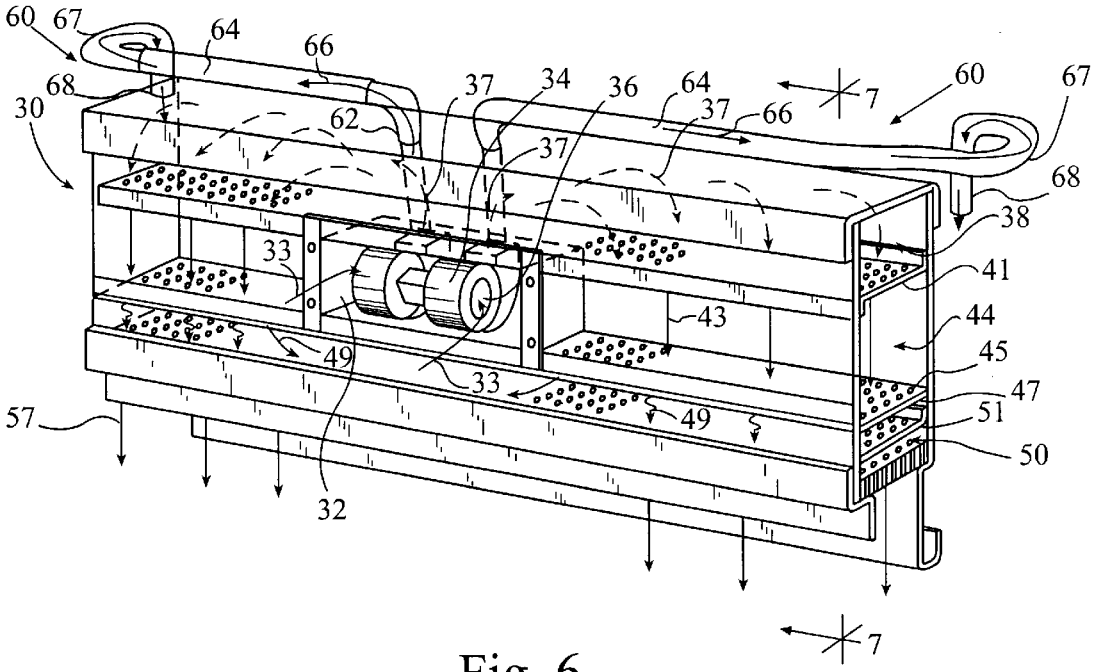
Fig. 6

Fig. 3
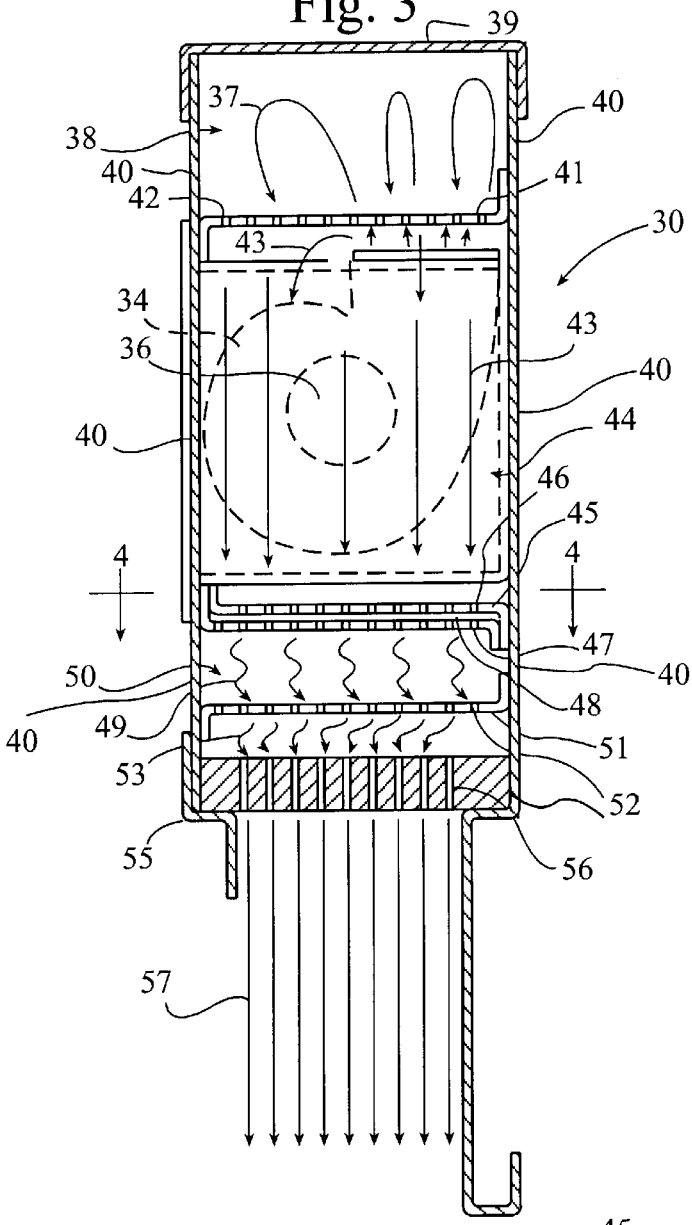
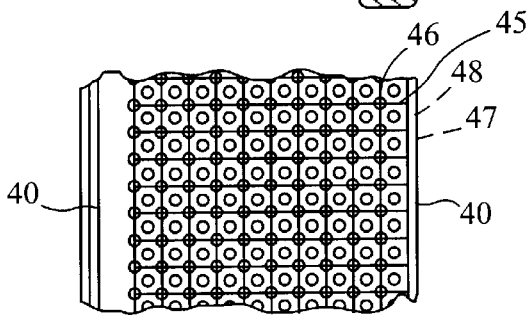
Fig. 4

FUME HOOD WITH AIR CHAMBER AND PRESSURE PIPE

CROSS NOTING TO RELATED APPLICATIONS

This application is a Continuation-In-Part of application Ser. No. 09/922,037 filed Aug. 3, 2001, now U.S. Pat. No. 6,506,109, issued Jan. 14, 2003.

BACKGROUND OF THE INVENTION

1. Field of the Invention

The present invention relates to a fume hood apparatus, and in particular to a fume hood apparatus with an air chamber that allows a lower sash face velocity while maintaining fume containment, thereby improving fume hood performance.

2. Description of the Related Art

Fume hoods are protective enclosures that provide ventilated and illuminated workspaces for laboratory or other applications. A fume hood in its most basic form is a box with an inlet and an outlet. The inlet generally has a movable sash (vertically, horizontally or a combination of both), which provides an opening that allows access to the workspace. The procedures performed inside the fume hood are exhausted at the back through the top of the fume hood to a heating, venting and air conditioning (HVAC) system.

An ideal fume hood system would use the least amount of conditioned room air possible while optimizing the containment levels necessary in order to perform the procedure. The need to exhaust less air is extremely important because it reduces the amount of conditioned air that is exhausted from the room through the hood, thereby lowering the operating cost of the fume hood.

The inventors of the present invention have recognized this problem and have developed a fume hood that provides containment levels dramatically better than the current industry standard recommendations. In addition, the inventors have developed a fume hood that can be adaptable to fume hoods with different types of airfoils, such as a raised airfoil, or an airfoil that is flush with the work surface, and the like.

SUMMARY OF THE INVENTION

The present invention comprises a fume hood apparatus including an enclosure, a movable sash and an air chamber. The air chamber includes an inlet for drawing air into the air chamber. Initially, the airflow travels upward into the air chamber. A backpressure redirects the airflow to travel downward through one or more baffles that evenly distribute the airflow within the air chamber as the airflow travels through the air chamber. A discharge positioned proximate to the face of the fume hood directs an unimpeded flow of air through the face of the fume hood. When the air moves into the fume hood around the technician's body a reverse vortex is created between the technician's body and face of the fume hood in the breathing zone. By directing an unimpeded flow of clean air downward across the breathing zone of the technician, the clean air from the air chamber reduces the forward momentum of air trying to escape the fume hood, thereby preventing airborne contaminants from escaping through the face of the fume hood. Airborne contaminants are prevented from escaping from the workspace even when the movable sash is fully opened resulting in improved containment performance.

In an alternative embodiment of the invention, the fume hood includes an air chamber located in front of the movable sash and above the technician. As in the earlier embodiment, the air chamber draws room air in and redirects the airflow in a controlled manner down in front between the technician and the movable sash. In addition, the alternative embodiment includes a pressure pipe that draws in a small quantity of air from the air chamber and distributes the airflow between the backside of the movable sash and the front of the header panel. When the airflow that is directed out the bottom of the air chamber clears the bottom of the movable sash, the airflow is then drawn into the workspace and exhausted. The small quantity of airflow from the pressure pipe introduced between the movable sash and the front header sweeps the area clean and the airflow is also drawn into the workspace and exhausted. The air chamber in combination with the pressure pipe maintains fume containment at lower face velocities as compared to conventional fume hood designs.

Various aspects and advantages of this invention will become apparent to those skilled in the art from the following detailed description of the preferred embodiment, when read in light of the accompanying drawings.

BRIEF DESCRIPTION OF THE DRAWINGS

FIG. 2 is a perspective view of the air chamber of the present invention;

FIG. 3 is a cross-sectional view of the air chamber taken along line 3—3 of FIG. 2;

FIG. 4 is a cross-sectional view of an airfoil taken along line 4—4 of FIG. 3;

FIG. 6 is a perspective view of the air chamber with the pressure pipe according to the alternative embodiment of the present invention.

DESCRIPTION OF THE PREFERRED EMBODIMENT

Figure 1:
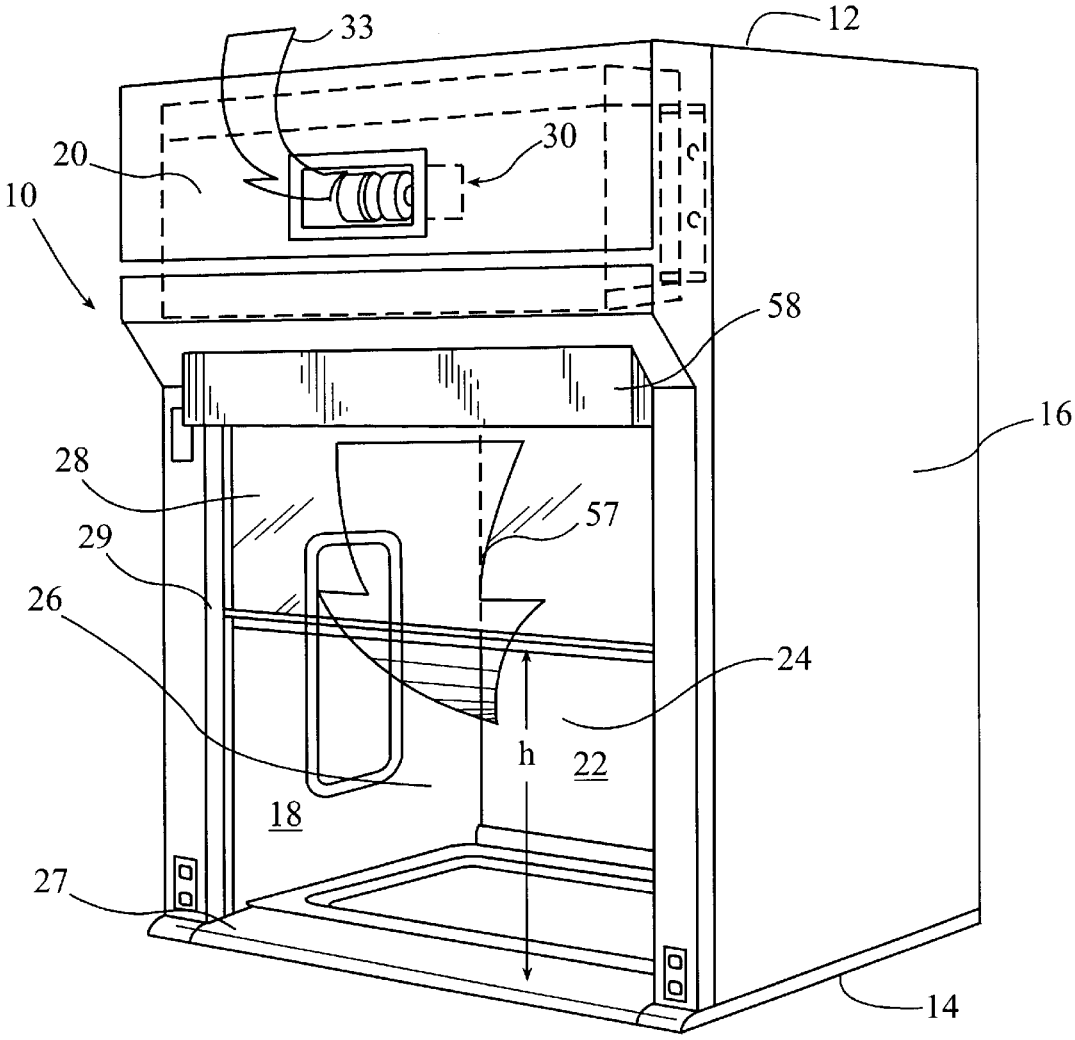
FIG. 1 is a perspective view of the fume hood apparatus of the present invention.

Referring now to FIGS. 1–4, a fume hood apparatus is shown generally at 10 according to the present invention. The fume hood apparatus 10 generally includes an enclosure comprising a cover or top 12, a bottom 14 opposite the top 12, sidewalls including a first end panel 16, a second end panel 18 opposite the first end panel 16, a front panel 20, and a back panel 22 opposite the front panel 20. The enclosure may be made of metal or any other material of high strength and rigidity.

The enclosure defines a workspace 24 and an access opening 26 through which a technician may reach into the workspace 24. A moveable sash 28 is slidably mounted to the enclosure in a frame member 29 to allow the selective closing of the opening 26 and precluding access to the workspace 24. The sash 28 is preferably made of glass or any other similar material. The technician may raise the sash 28 to allow access through the opening 26, as shown in FIG. 1, or lower the sash 28 to close the opening 26.

The fume hood apparatus 10 may include a baffle system (not shown) that cooperates with a fan (not shown) to evacuate any fumes generated in the workspace 24. Typically, the baffle system lies at the back of the workspace 24 and directs the fumes to a discharge conduit (not shown).

As the fan draws the air and fumes out of the workspace 24, ambient air flows into the workspace 24, primarily through the opening 26. The fume hood apparatus may also include a base member (not shown) to define a work surface and for positioning the fume hood apparatus 10 at a desired elevation for the technician, and an airfoil 27. It will be understood that the invention is not limited by the type of baffle system, base member or airfoil, and that the invention can be practiced with any type of baffle system, base member, and airfoil well known in the art. Examples of a baffle system, a base member and an airfoil are described in U.S. Pat. No. 5,556,331 to Bastian, the entire contents of which are herein incorporated by reference.

One aspect of the invention is that the fume hood apparatus includes an air chamber, shown generally at 30, preferably located in the front panel 20 of the enclosure. In general, the air chamber 30 includes an upper portion 38, a middle portion 44 and a bottom portion 50.

As best seen in FIG. 2, the middle portion 44 of the air chamber 30 includes an inlet 32 for outside or drawing room air into the air chamber 30 in the direction of arrows 33. Preferably, the air is drawn into the inlet 32 of the air chamber 30 by a centrifugal fan 34 driven by a rotating means, such as a motor 35. As best shown in FIG. 3, the air is drawn into suction 36 of the centrifugal fan 34 and exits the centrifugal fan 34 in an upward direction, as indicated by the arrows 37, into the upper portion 38 of the air chamber 30. In one embodiment of the invention, the centrifugal fan 34 provides an airflow in the range of between about 40 to about 250 cubic feet/minute through the air chamber 30.

The upper portion 38 is defined by an upper wall 39, sidewalls 40, and a baffle 41. The baffle 41 includes a plurality of perforations or openings 42 for allowing a portion of the intake air to travel upward and pass through the openings 42, as designated by the arrows 37. It should be noted that the outlet of the centrifugal fan 34 is not positioned into abutting engagement with the baffle 41, but is positioned at a predetermined distance from the baffle 41. As a result, a portion of the intake air does not pass through the openings 42, but impinges upon the baffle 41 and travels downward, as indicated by the arrows 43. As a result, a backpressure is created within the upper portion 38 to redirect the airflow downwardly through the openings 42 of the baffle 41 and into the middle portion 44 of the air chamber 30.

The middle portion 44 of the air chamber 30 is defined by the baffle 41, the sidewalls 40 and a baffle 45. Similar to the baffle 41, the baffle 45 includes perforations or openings 46. The airflow travels downward, as indicated by the arrows 43, through the middle portion 44 of the air chamber 30. The middle portion 44 of the air chamber 30 may also include a baffle 47 with perforations or openings 48 that is positioned proximate to the baffle 45 to distribute the airflow more evenly as the air flows downward, as indicated by the arrows 49, into a bottom portion 50 of the air chamber 30. As best seen in FIG. 3, the baffles 45 and 47 are separated by a distance, "d", in the range between about 0.10 and about 0.25 inches. At this separation distance, it has been found that the redirecting and distribution of the airflow into the bottom portion 50 is optimized. However, it will be appreciated that the separation distance, "d", between baffles 45 and 47 can be any desired distance to optimize the redirecting and distribution of airflow into the bottom portion 50 of the air chamber 30. Preferably, the bottom portion 50 extends the entire length of the air chamber 30, unlike the middle portion 44 that houses the intake 32, centrifugal fan 34 and motor 35. As best seen in FIG. 4, the openings 48 of the baffle 47 are vertically and horizontally offset from the openings 46 of the baffle 45. This configuration ensures that the airflow is evenly distributed as the airflow travels within the bottom portion 50 of the air chamber 30. It will be appreciated that the invention is not limited by the degree in which the openings 46 and 48 are offset from each other, and that the invention can be practiced with any desired degree of offset.

Referring now to FIG. 3, the bottom portion 50 of the air chamber 30 is defined by the baffle 47, the sidewalls 40 and an air straightener 55. The bottom portion 50 also includes a baffle 51 with perforation or openings 52 to allow the airflow to travel through the bottom portion 50, as indicated by the arrows 53. After passing through the baffle 51, the airflow passes through an air straightener 55 having one or more ducts 56 for directing the airflow outwardly in a substantially uniformly linear direction from the air chamber 30, as indicated by the arrows 57. Referring now to FIG. 1, the fume hood apparatus 10 may include a discharge 58 to assist in directing the airflow from the air chamber 30.

It will be appreciated that the baffles 41, 45, 47 and 51 form a baffle system within the air chamber 30. One purpose of the baffle system is to redirect and evenly distribute the airflow as it travels downward through the air chamber 30. Although the baffle system of the invention includes baffles 41, 45, 47 and 51, it will be appreciated that the number of baffles within the air chamber 30 to redirect and evenly distribute the airflow does not limit the invention. Thus, the invention can be practiced with any desired number of baffles that would evenly distribute the airflow as it travels downward through the air chamber 30.

One aspect of the invention is the location at which the airflow exits the air chamber 30. Unlike conventional fume hood designs, the fume hood apparatus 10 of the invention directs the airflow at a location above the technician and between the technician and the movable sash 28. Specifically, the discharge 58 is located immediately adjacent and proximate to the movable sash 28 in such a manner that a technician does not impede the airflow from the discharge 58, unlike conventional fume hood designs. At this location, it has been found that the face velocity of the fume hood apparatus 10 is reduced while maintaining requirements for adequate containment of the fumes. It has also been found that the centrifugal fan 34 is required to operate when the access opening 26 has a minimum amount of surface area for a particular amount of airflow.

As best seen in FIG. 1, the centrifugal fan 34 may only need to be operated when the movable sash 28 is positioned, for example, at or above a minimum height, "h", of about 18 inches above the bottom 14 of the fume hood apparatus 10. The centrifugal fan 34 can be switched on and off by any well-known type of switching means, such as a limit switch (not shown). Operating the centrifugal fan 34 only when the movable sash 28 is positioned at or above the minimum height, "h", provides for a more energy efficient design as compared to a fume hood design in which the fan is continuously operated. Of course, the invention can be practiced with a continuously operated centrifugal fan 34. In addition, the invention can be practiced with other types of fans. It should be noted that the air could be introduced into the air chamber 30 at other locations than the front panel 20. For example, the air may be introduced into the top 12 or the sides 16 of the fume hood apparatus 10.

In addition, by providing an airflow at this location allows the fume hood apparatus 10 to maintain containment requirements even though the movable sash 28 is positioned above the minimum distance from the bottom 14 and the airfoil 27 is flush with the bottom 14. This aspect of the invention provides a significant advantage over conventional fume hood designs in which the access opening must be reduced by requiring a raised airfoil and/or lower the movable sash 28 in order to achieve the required containment level at low face velocities.

Figure 5:
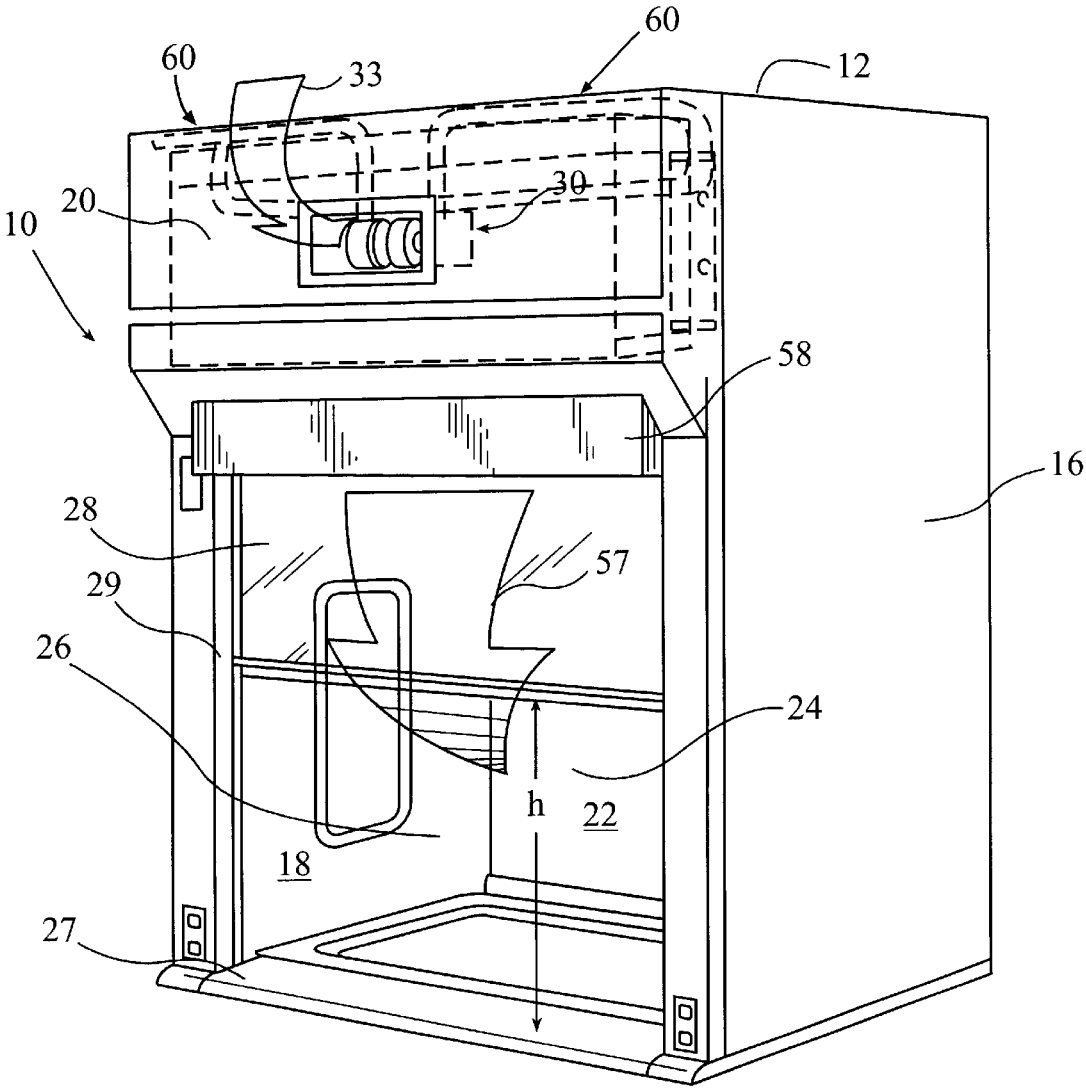
FIG. 5 is a perspective view of the fume hood apparatus with the air chamber and a pressure pipe according to an alternative embodiment of the present invention.
Figure 7:
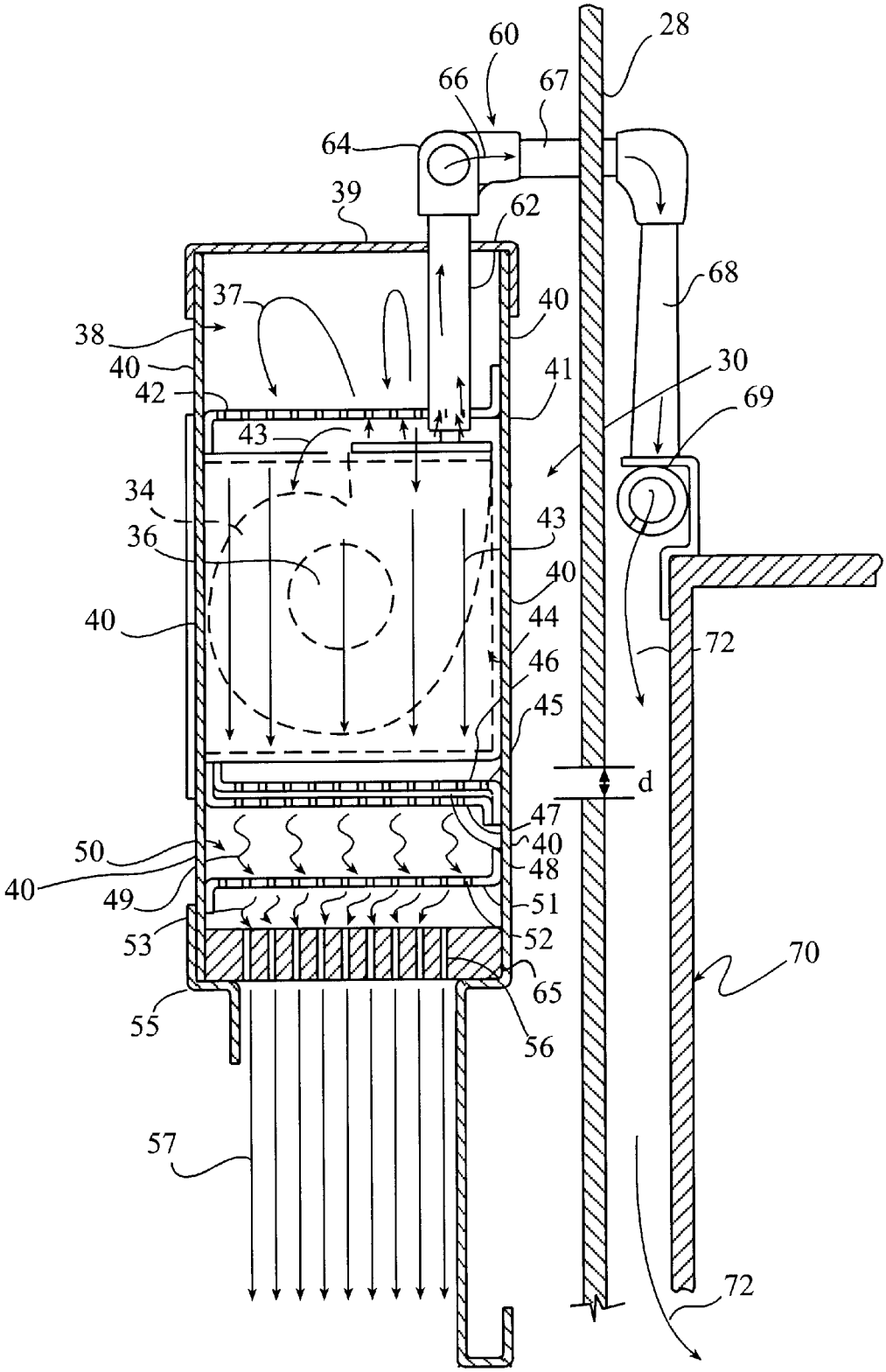
FIG. 7 is a cross-sectional view of the air chamber with the pressure pipe taken along line 7—7 of FIG. 6.

Referring now to FIGS. 5 through 7, a fume hood apparatus is shown generally at 10' according to an alternative embodiment of the present invention. For brevity, the similar components of the fume hood apparatus 10' are given the same reference numerals as in the fume hood apparatus 10 and will not be discussed below.

The fume hood apparatus 10' is substantially similar to the fume hood apparatus 10, except that the fume hood apparatus 10' includes a pressure pipe, shown generally at 60. As best seen in FIG. 7, the pressure pipe 60 includes an inlet 62 preferably located in the upper portion 38 of the air chamber 30 in proximity to where the air exits the centrifugal fan 34 in the upward direction, as indicated by the arrows 37. As best seen in FIG. 6, the air drawn into the inlet 62 of the pressure pipe 60 travels transversely, as indicated by the arrows 66, along a straight portion 64 of the pressure pipe 60, through a U-shaped portion 67, through a downwardly extending portion 68, and exits the pressure pipe 60 through an outlet 69. The length of the straight portion 64 of the pressure pipe 60 is such that the movable sash 28 can move up and down to increase and decrease the access opening 26, respectively. As best seen in FIG. 7, the outlet 69 is preferably located between the movable sash 28 and a header panel 70 of the fume hood apparatus 10'. As the air exits the outlet 69, the air travels downwardly between the movable sash 28 and the header panel 70, as indicated by the arrows 72, and into the workspace 24.

One aspect of the alternate embodiment of the invention is that the pressure pipe 60 directs a small quantity of air from the air chamber 30 and distributes the air between the backside of the movable sash 28 and the front of the header panel 70. Preferably, the quantity of air is between about 5 to about 15 cubic feet/minute, depending on the size of the workspace. This small airflow increases the relative pressure difference between the movable sash 28 and the header panel 70, thereby minimizing contamination at low face velocities. In conventional fume hood designs, the negative static pressure inside the fume hood is reduced as the airflow through the fume hood is reduced. As a result, the relative pressure difference between the inside and the outside of the fume hood is so close that the contamination could migrate into the sash track or other small openings around the movable sash and escape into the surrounding room. The fume hood apparatus 10' including the air chamber 30 in combination with the pressure pipe 60 of the invention provides containment levels dramatically better than conventional fume hood designs.

While the invention has been specifically described in connection with certain specific embodiments thereof, it is to be understood that this is by way of illustration and not of limitation, and the scope of the appended claims should be construed as broadly as the prior art will permit.

What is claimed is:

1. A fume hood apparatus, comprising:

an enclosure defining a workspace and an access opening, the enclosure including a header panel;

a movable sash for closing the access opening;

an air chamber having an inlet for drawing a quantity of room air at a predetermined airflow into the air chamber and a discharge proximate to the movable sash; and a pressure pipe having an inlet for drawing a quantity of air from the air chamber and an outlet positioned between the movable sash and the header panel for supplying a quantity of air between the moveable sash and the header panel and into the workspace wherein the pressure pipe increases a relative pressure difference between the movable sash and the header panel, thereby minimizing contamination.

2. The fume hood apparatus of claim 1, wherein the air chamber includes a centrifugal fan having an outlet for creating a pressure within the air chamber.

3. The fume hood apparatus of claim 2, wherein the inlet of the pressure pipe is proximate to the outlet of the centrifugal fan.

4. The fume hood apparatus of claim 1, wherein the airflow from the outlet of the pressure pipe is in a range between about 5 to about 15 cubic feet/minute.

5. A fume hood apparatus, comprising:

an enclosure defining a workspace and an access opening, the enclosure including a header panel;

a movable sash for closing the access opening;

an air chamber including an upper portion, a middle portion, and a lower portion, the middle portion having an inlet for drawing a quantity of outside air at a predetermined airflow into the air chamber, and a discharge adjacent the movable sash for directing an unimpeded flow of air from the lower portion of the air chamber through the access opening and into the workspace; and a pressure pipe having an inlet for drawing a quantity of air from the upper portion of the air chamber and an outlet positioned between the movable sash and the header panel for directing a flow of air between the moveable sash and the header panel and into the workspace, wherein the pressure pipe increases a relative pressure difference between the movable sash and the header panel, thereby minimizing contamination.

6. The fume hood apparatus of claim 5, wherein the air chamber includes a centrifugal fan having an outlet for creating a pressure within the air chamber.

7. The fume hood apparatus of claim 6, wherein the inlet of the pressure pipe is proximate to the outlet of the centrifugal fan.

8. The fume hood apparatus of claim 5, wherein the airflow from the outlet of the pressure pipe is in a range between about 5 to about 15 cubic feet/minute.

9. A method of minimizing airborne contaminants from escaping a workspace of a fume hood having a movable sash and a header panel, comprising the steps of:

supplying an airflow to an air chamber of the fume hood;

drawing a portion of the airflow within the air chamber into a pressure pipe positioned between the movable sash and the header panel; and supplying a quantity of air from the pressure pipe between the moveable sash and the header panel and into the workspace of the fume hood, whereby the flow of air from the pressure pipe increases a relative pressure difference between the movable sash and the header panel, thereby minimizing airborne contaminants from escaping through the face of the fume hood.

* * * * *